US012790705B2

(12) United States Patent
Maier et al.

(10) Patent No.: US 12,790,705 B2
(45) Date of Patent: Nov. 10, 2026

(54) METHOD FOR RECOVERING NOBLE METAL FROM HETEROGENEOUS CATALYSTS CONTAINING NOBLE METAL

(71) Applicant: Heraeus Deutschland GmbH & Co. KG, Hanau (DE)

(72) Inventors: Dirk Maier, Hanau (DE); Christian Gebauer, Hanau (DE)

(73) Assignee: HERAEUS DEUTSCHLAND GMBH & CO. KG, Hanau (DE)

( * ) Notice: Subject to any disclaimer, the term of this patent is extended or adjusted under 35 U.S.C. 154(b) by 703 days.

(21) Appl. No.: 18/248,987

(22) PCT Filed: Aug. 31, 2021

(86) PCT No.: PCT/EP2021/073936
§ 371 (c)(1),
(2) Date: Apr. 13, 2023

(87) PCT Pub. No.: WO2022/078667
PCT Pub. Date: Apr. 21, 2022

(65) Prior Publication Data

US 2023/0407503 A1 Dec. 21, 2023

(30) Foreign Application Priority Data

Oct. 16, 2020 (EP) ..... 20202223

(51) Int. Cl.

| | |
|---|---|
| ***C25B 9/00*** | (2021.01) |
| ***C22B 3/10*** | (2006.01) |
| ***C22B 11/00*** | (2006.01) |
| ***C25C 1/20*** | (2006.01) |

(52) U.S. Cl.
CPC ..... *C25C 1/20* (2013.01); *C22B 3/10* (2013.01); *C22B 11/048* (2013.01)

(58) Field of Classification Search
CPC ..... C25C 1/20; C22B 3/10; C22B 11/048
See application file for complete search history.

(56) References Cited

U.S. PATENT DOCUMENTS

| | | | | |
|---|---|---|---|---|
| 4,775,452 | A | 10/1988 | Kuninaga et al. | |
| 7,166,145 | B1 | 1/2007 | Han | |
| 2004/0115107 | A1 | 6/2004 | Singh | |
| 2008/0254311 | A1* | 10/2008 | Chen | C25D 5/611 205/265 |

FOREIGN PATENT DOCUMENTS

| | | | |
|---|---|---|---|
| CN | 111549231 | A | 8/2020 |
| DE | 102006056017 | A1 | 5/2008 |
| DE | 102011014505 | A1 | 9/2012 |
| EP | 0363314 | A1 | 4/1990 |
| EP | 2985354 | A1 | 2/2016 |
| EP | 3591082 | A1 | 1/2020 |

OTHER PUBLICATIONS

Grehl M, et al., "Technological Aspects in PGM Refining" World of Metallurgy—Erzmetall, GDMB—Medienverlag, Clausthal-Zellerfeld, DE, vol. 59, No. 2, Mar. 1, 2006 (Mar. 1, 2006), pp. 81-86 ISSN: 1613-2394, XP 001243814; paragraphs 6.2, 6.4.3.
Matthias Grehl, Horst Meyer, Joachim Kralik, Technilogical Aspects in PGM Refining, World of Metallurgy—Erzmetall, GDMB, Bd. 59, Nr. 2, Seiten 81-86, XP001243814, Mar. 1, 2006, Medienverlag, Clausthal-Zellerfeld, DE.

* cited by examiner

*Primary Examiner* — Zulmariam Mendez
(74) *Attorney, Agent, or Firm* — Blank Rome LLP

(57) ABSTRACT

A method for recovering noble metal from a heterogeneous catalyst comprising a solid carrier material and palladium, platinum or rhodium, present at least partially in elemental form, said method comprising the steps of converting the noble metal to an oxidation state>0 by treating the heterogeneous catalyst with an oxidizing agent in the presence of hydrochloric acid so as to form a two-phase system A comprising a hydrochloric aqueous phase A1 and a solid phase comprising the carrier material which is insoluble therein, optionally, at least partially separating the hydrochloric aqueous phase A1 from the two-phase system A and adding a further aqueous phase to the remaining residue of the two-phase system A so as to form a two-phase system B comprising a hydrochloric aqueous phase and a solid phase comprising the carrier material insoluble therein.

12 Claims, No Drawings

METHOD FOR RECOVERING NOBLE METAL FROM HETEROGENEOUS CATALYSTS CONTAINING NOBLE METAL

The present invention relates to a method for recovering noble metal from noble metal-containing heterogeneous catalysts.

The term "noble metal-containing heterogeneous catalyst" used herein, or "heterogeneous catalyst" for short, is understood to mean a carrier material which is equipped with catalytically active noble metal or comprises catalytically active noble metal species.

In the case of a large number of chemical processes, noble metals or noble metal-containing species are nowadays used as catalysts, either in the form of a homogeneous catalyst or in the form of a heterogeneous catalyst. In homogeneous catalysis, the catalytically active noble metal species is homogeneously mixed with the reactants, for example in solution, while the catalytically active noble metal species in heterogeneous catalysis are present on and/or within an at least substantially inert carrier material and form a heterogeneous mixture with the reactants. In many cases, heterogeneous catalysts are preferred since they can be removed from a reaction mixture in a simple manner, for example by filtration. A large number of industrial chemical processes, such as reforming used in fuel production or the production of monomers for polymer chemistry, use heterogeneous catalysts on a multi-ton scale. Heterogeneous catalysts are however also widely used in gas purification, such as in the case of exhaust gas or exhaust air aftertreatment.

In order to ensure a high catalytic activity, noble metals are typically applied finely distributed on inner and/or outer surfaces of at least substantially inert carrier materials in heterogeneous catalysts. Such carrier materials are typically porous and enable a uniform distribution of the catalytically active noble metal species on a large surface area.

After a certain operating time, the activity of noble metal-containing catalysts and the spent catalysts must be replaced. Due to the high noble metal price, use of noble metal-containing catalysts is often economical only when the noble metal used can be recovered.

For the purpose of noble metal recovery, spent noble metal-containing heterogeneous catalysts are typically subjected to hydrometallurgical methods as described, for example, in EP 2 985 354 A1. The noble metal-containing heterogeneous catalysts are subjected to an oxidation step in which the noble metal is brought into a water-soluble form. Subsequently, this water-soluble noble metal species is removed from the carrier material in a plurality of washing steps. The noble metal must then be recovered from the combined washing media, which requires the handling of large liquid volumes as well as energy- and time-consuming steps. U.S. Pat. No. 7,166,145 B1 describes, for example, how noble metals can be recovered from such combined washing media in a multi-stage method by means of final electrolytic deposition; previously, separation into solid (carrier material) and liquid components (aqueous phase containing noble metals and comprising the washing media) takes place.

The object of the present invention was to find an efficient method for the at least almost complete recovery of noble metal, more precisely of palladium and/or platinum and/or rhodium, of or from heterogeneous catalysts containing noble metal, more precisely palladium and/or platinum and/or rhodium. In particular, it was part of the object to provide a method which requires little washing medium.

The object can be achieved by a method for recovering noble metal of and/or from a heterogeneous catalyst which comprises a solid carrier material and at least one noble metal which is selected from the group consisting of palladium (Pd), platinum (Pt), and rhodium (Rh) and is at least partially present in elemental form, comprising the successive steps of:

(a) converting the at least one noble metal present at least partially in elemental form into an oxidation state>0 by treating the heterogeneous catalyst with oxidizing agent in the presence of hydrochloric acid to form a two-phase system A comprising a hydrochloric aqueous phase A1 and a solid phase comprising the carrier material that is insoluble therein, (b) optionally, but preferably, at least partially separating the hydrochloric aqueous phase A1 from the two-phase system A and adding a further aqueous phase to the remaining residue of the two-phase system A to form a two-phase system B comprising a hydrochloric aqueous phase B1 and a solid phase comprising the carrier material that is insoluble therein, (b') if step (b) has taken place, optionally, once or multiple times, repeatedly at least partially separating the hydrochloric aqueous phase from the two-phase system formed in the preceding step, and adding a further aqueous phase to form a further two-phase system comprising a hydrochloric aqueous phase and a solid phase comprising the carrier material that is insoluble therein, and (c) cathodic electro-deposition of the at least one noble metal either (c1) from the hydrochloric aqueous phase A1 of the two-phase system A or (c2) from the hydrochloric aqueous phase B1 of the two-phase system B or (c3) from the hydrochloric aqueous phase of the two-phase system formed finally in step (b').

The term "oxidation state" used herein and known to the person skilled in the art means the formal charge of an atom within a compound or the actual charge of monatomic ions. By definition, atoms in the elemental state have the oxidation state 0.

Herein, repeated mention is made of a two-phase system comprising a hydrochloric aqueous phase and a solid phase comprising or consisting of the carrier material that is insoluble in the hydrochloric aqueous phase. The solid phase can be distributed in the sense of a suspension in the two-phase system or can also partially be present settled on the bottom, or form the lower of the two phases. The latter is in particular the case in the resting state.

Steps (a), (b), (b'), and (c) are successive steps and may be directly successive steps without intermediate steps. Step (a) takes place before steps (b), (b'), and (c). In addition to the optionally, but preferably, carried out step (b), the method according to the invention may also comprise further method steps which are carried out before step (a), between steps (a) to (c), or after step (c). The preferably carried out step (b) may be followed by an optional step (b'), which takes place before step (c). If step (b') takes place, steps analogous to step (b) are carried out in this step once or multiple times, wherein, in each case, at least a portion of a hydrochloric aqueous phase is separated from a relevant two-phase system and a further aqueous phase is added to the remaining part of the relevant two-phase system. For example, a hydrochloric acid solution, hydrochloric acid, or water may be suitable as a further aqueous phase to be added.

In one embodiment, the method according to the invention comprises successive steps (a) and (c) with step (c) in variant (c1), without steps (b) and (b'). In other words, it is then a method for recovering noble metal of and/or from a heterogeneous catalyst which comprises a solid carrier material and at least one noble metal which is selected from the group consisting of palladium, platinum, and rhodium and is present at least partially in elemental form, comprising the successive steps of:

(a) converting the at least one noble metal present at least partially in elemental form into an oxidation state>0 by treating the heterogeneous catalyst with oxidizing agent in the presence of hydrochloric acid to form a two-phase system A comprising a hydrochloric aqueous phase A1 and a solid phase comprising the carrier material that is insoluble therein, and (c) cathodic electro-deposition of the at least one noble metal from the hydrochloric aqueous phase A1 of the two-phase system A, and without steps (b) and (b'). Cathodic electro-deposition from the hydrochloric aqueous phase A1 of the two-phase system A means that step (c) takes place in the presence of the solid carrier material that is insoluble in the hydrochloric aqueous phase A1.

The noble metal recovery takes place here electrolytically by way of cathodic electro-deposition.

In a preferred embodiment, the method according to the invention comprises successive steps (a), (b), and (c) with step (c) in variant (c2), without step (b'). In other words, it is then a method for recovering noble metal of and/or from a heterogeneous catalyst which comprises a solid carrier material and at least one noble metal which is selected from the group consisting of palladium, platinum, and rhodium and is present at least partially in elemental form, comprising the successive steps of:

(a) converting the at least one noble metal present at least partially in elemental form into an oxidation state>0 by treating the heterogeneous catalyst with oxidizing agent in the presence of hydrochloric acid to form a two-phase system A comprising a hydrochloric aqueous phase A1 and a solid phase comprising the carrier material that is insoluble therein, (b) at least partially separating the hydrochloric aqueous phase A1 from the two-phase system A, and adding a further aqueous phase to the remaining residue of the two-phase system A to form a two-phase system B comprising a hydrochloric aqueous phase B1 and a solid phase comprising the carrier material that is insoluble therein, and (c) cathodic electro-deposition of the at least one noble metal from the hydrochloric aqueous phase B1 of the two-phase system B, and without step (b'). Cathodic electro-deposition from the hydrochloric aqueous phase B1 of the two-phase system B means that step (c) takes place in the presence of the solid carrier material that is insoluble in the hydrochloric aqueous phase B1. The hydrochloric aqueous phase A1, which is at least partially separated off in step (b) of this preferred embodiment of the method according to the invention, is further processed by customary, for example hydrometallurgical, methods known to the person skilled in the art, for the purpose of recovering the noble metal(s) dissolved therein. A recovery of noble metal by means of cathodic electro-deposition from the at least partially separated hydrochloric aqueous phase A1 preferably does not take place. In the overall view, noble metal recovery takes place here partially non-electrolytically, for example hydrometallurgically, and partially electrolytically by way of cathodic electro-deposition.

In yet another embodiment, the method according to the invention comprises the successive steps (a), (b), (b'), and (c) with step (c) in variant (c3). In other words, it is then a method for recovering noble metal of and/or from a heterogeneous catalyst which comprises a solid carrier material and at least one noble metal which is selected from the group consisting of palladium, platinum, and rhodium and is present at least partially in elemental form, comprising the successive steps of:

(a) converting the at least one noble metal present at least partially in elemental form into an oxidation state>0 by treating the heterogeneous catalyst with oxidizing agent in the presence of hydrochloric acid to form a two-phase system A comprising a hydrochloric aqueous phase A1 and a solid phase comprising the carrier material that is insoluble therein, (b) at least partially separating the hydrochloric aqueous phase A1 from the two-phase system A, and adding a further aqueous phase to the remaining residue of the two-phase system A to form a two-phase system B comprising a hydrochloric aqueous phase B1 and a solid phase comprising the carrier material that is insoluble therein, (b') once or multiple times repeatedly, at least partially separating the hydrochloric aqueous phase from the two-phase system formed in the preceding step, and adding a further aqueous phase to form a further two-phase system comprising a hydrochloric aqueous phase and a solid phase comprising the carrier material that is insoluble therein, and (c) cathodic electro-deposition of the at least one noble metal from the hydrochloric aqueous phase of the two-phase system formed finally in step (b'). Cathodic electro-deposition from the hydrochloric aqueous phase of the two-phase system formed finally in step (b') means that step (c) takes place in the presence of the solid carrier material that is insoluble in the hydrochloric aqueous phase. The hydrochloric aqueous phases A1 and B1, which are at least partially separated off in steps (b) and (b') in this embodiment of the method according to the invention, and optionally further hydrochloric aqueous phases which are at least partially separated off in step (b'), can in each case be processed further, either by themselves or expediently in combination with one another, by customary, for example hydrometallurgical, methods known to the person skilled in the art, for the purpose of recovering the noble metal(s) dissolved therein. Preferably, a recovery of noble metal by means of cathodic electro-deposition from the at least partially separated hydrochloric aqueous phase A1 and B1 and the optionally further hydrochloric aqueous phases which are at least partially separated off in step (b') does not take place. In the overall view, noble metal recovery takes place here partially non-electrolytically, for example hydrometallurgically, and partially electrolytically by way of cathodic electro-deposition.

For all three aforementioned embodiments of the method according to the invention, it is essential to the invention that the cathodic electro-deposition according to step (c) advantageously takes place from the hydrochloric aqueous phase of the two-phase system in question, i.e., in each case in the presence of the solid carrier material that is insoluble in the relevant hydrochloric aqueous phase or, in other words, in all cases in the presence of the entire relevant two-phase system A or B or the two-phase system formed finally in step (b').

The heterogeneous catalyst treated with oxidizing agent in the presence of hydrochloric acid in the method according to the invention comprises a solid carrier material and at least one noble metal which is present at least partially in elemental form and is selected from the group consisting of palladium, platinum, and rhodium; in other words, the heterogeneous catalyst comprises a solid carrier material and palladium and/or platinum and/or rhodium, which in each case is present at least partially in elemental form. In addition to palladium and/or platinum and/or rhodium, the heterogeneous catalyst preferably does not comprise any further noble metals. In one embodiment, the heterogeneous catalyst consists of a solid carrier material and of palladium and/or platinum and/or rhodium, which in each case is present at least partially in elemental form. Any noble metal that is not present in elemental form may be present as a noble metal compound in a positive oxidation state, for example as a noble metal oxide. The noble metal content of the heterogeneous catalyst formed from palladium, platinum, and/or rhodium may, for example, be in the range of 0.02 to 80 wt. % (% by weight). As stated, the at least one noble metal present at least partially in elemental form is selected from the group consisting of palladium, platinum, and rhodium. Said precious metals can be present in alloyed form with one another. Preferably, these are platinum present at least partially in elemental form and/or palladium present at least partially in elemental form.

Herein, reference is made to solid carrier material. This is understood to mean a virtually noble metal-free solid carrier which can be equipped with a catalytically active noble metal or catalytically active noble metal species. Suitable solid carrier materials are chemically at least largely inert to many different conditions or reaction conditions; this can also be ensured for the carbon-based carriers mentioned below. In particular, the solid carrier material is at least largely inert to acidic and oxidizing media, preferably also to basic media. It is insoluble in aqueous media in a pH range of −1 to +7, preferably also in the alkaline range. "Insoluble" is not to be understood in absolute terms here; the person skilled in the art understands it as being substantially insoluble or virtually insoluble. Suitable carrier materials are commercially available or can be produced using conventional methods known to the person skilled in the art. Examples of carrier materials are inorganic ceramic materials, for example pure oxide ceramics, such as aluminum oxide, zirconium oxide, titanium dioxide, silicon dioxide, but also mixed oxide ceramics, such as aluminum titanate and dispersion ceramic ($Al_2O_3/ZrO_2$). The carrier materials can be doped with further elements, such as rare earth metals. Further examples of carrier materials include non-oxide ceramics, such as silicon carbide, silicon nitride, aluminum nitride, boron carbide, and boron nitride. Further examples are silicate-based materials, in particular aluminum silicates, very particularly zeolites.

A further class of possible carrier materials is carbon-based materials. As already mentioned, the carrier materials have to have at least some resistance to the conditions prevailing under the catalytic operating conditions and the conditions of the method according to the invention. If the carrier material is a carbon material, it may be preferred that this carbon material has a high degree of graphitization. Suitable carbon-based carrier materials with a high degree of graphitization are also commercially available, for example under the name Porocarb® from Heraeus.

In general, the heterogeneous catalysts treated with oxidizing agent in the presence of hydrochloric acid in step (a) of the method according to the invention are materials with a large surface area, for example with a BET surface area of 10 to 500 $m^2/g$, preferably 300 to 500 $m^2/g$. In general, these are porous materials. The BET surface area can be determined by means of BET measurement according to DIN ISO 9277 (according to chapter 6.3.1, static volumetric measurement method, gas used: nitrogen). Unless otherwise noted, all standards cited herein are in each case the current version at the time of the priority date of the present patent application. The open porosity can be expressed via the open pore volume. The open pore volume can be determined by means of mercury porosimetry or by determining the water absorption capacity. It may, for example, be in the range of 0.2 to 1.2 ml/g. The porosity can be formed by pores of various orders of magnitude, for example meso- and/or macropores. The pore sizes may, for example, be in the range of 5 nm to 10 μm.

The heterogeneous catalyst may be present in particulate form. The average particle size d50 of the carrier material may, for example, be in the range of 3 to 100 μm. The average particle size d50 can be determined by laser diffraction methods using a particle size analyzer. However, the heterogeneous catalyst may also be in the form of molded bodies. Examples of molded bodies include strands, cylinders, pellets, rings, multi-hole rings, balls, saddle bodies, wheels, chairs, foam bodies, and honeycombs. Such molded bodies may have a diameter of, for example, 100 μm up to 50 cm at the thickest point. The heterogeneous catalyst can incidentally be comminuted, for example milled, before step (a), independently of whether it is present in particulate form or as a molded body shaped as defined.

In general, the heterogeneous catalysts treated with oxidizing agent in the presence of hydrochloric acid in the method according to the invention are spent heterogeneous catalysts. A spent heterogeneous catalyst is a heterogeneous catalyst whose catalytic activity has decreased after a certain operating time and is no longer sufficient. Depending on the process in which the spent heterogeneous catalyst was used, noble metal species modified with respect to the original catalytically active noble metal species and/or further originally non-present substances can be located on the carrier material. It may therefore be expedient to subject the heterogeneous catalyst to further pretreatment steps, in addition to the aforementioned possible mechanical comminution, prior to carrying out the method according to the invention, more precisely, prior to carrying out method step (a). In this respect, the heterogeneous catalysts may be or may have been pretreated accordingly before step (a). For example, a pretreatment in the form of a thermal treatment or an annealing can be advantageous. This is primarily expedient if organic substances occupy the heterogeneous catalyst after its use and are to be removed before step (a) by pyrolysis and/or combustion. If the heterogeneous catalyst does not comprise noble metal in elemental form but as a noble metal species in a higher oxidation state, a reducing pretreatment, particularly advantageously in reducing atmosphere, can expediently be carried out. In particular, a pretreatment before step (a) can accordingly comprise a thermal treatment, a reduction treatment, or a thermal treatment followed by a reduction treatment.

In method step (a), the at least one noble metal at least partially present in elemental form is converted by treating the heterogeneous catalyst with oxidizing agent in the presence of hydrochloric acid into an oxidation state>0 to form a two-phase system A comprising a hydrochloric aqueous phase A1 and a solid phase comprising the carrier material that is insoluble therein.

During method step (a), initially there is a reaction system which comprises the heterogeneous catalyst comprising the carrier with the at least one noble metal present at least partially in elemental form, hydrochloric acid, and one or more oxidizing agents. After the completion of method step (a), a two-phase system A comprising a hydrochloric aqueous phase A1 and a solid phase comprising the carrier material that is insoluble therein are obtained. The hydrochloric aqueous phase A1 comprises the noble metal removed from the carrier and now present in an oxidation state>0 in dissolved form. The solid phase comprises the carrier material which is insoluble in the hydrochloric aqueous phase A1 and is substantially freed of the noble metal as particles and/or as molded bodies.

The hydrochloric acid used in method step (a) may, for example, be a concentration in the range of 1 to 12 mol of acid ($H_3O^+$) per liter.

The oxidizing agent(s) used in method step (a) may be solid, liquid, or gaseous. Examples of usable solid oxidizing agents known to the person skilled in the art include chlorates, nitrates, bromates, iodates, chlorites, bromites, iodites, hypochlorites, perchlorates, and peroxide compounds. Such oxidizing agents can in particular be present as salts of alkali metals or alkaline earth metals. Suitable liquid oxidizing agents are, for example, aqueous solutions of the stated solid oxidizing agents and/or hydrogen peroxide. Suitable gaseous oxidizing agents are in particular chlorine and ozone. The oxidizing agents can be used individually or in any combination.

The exposure time of the at least one oxidizing agent is not further limited. In a preferred embodiment, the exposure time can be 5 to 240 minutes, particularly preferably 10 to 120 minutes, and in particular 15 to 60 minutes. The oxidation step may be carried out in a temperature range of, for example, 20 to 80° C. or even up to boiling temperature.

After treatment with the oxidizing agent, the at least one noble metal is present in an oxidation state>0. Preferably, for example, palladium is present as Pd(II) and/or Pd(IV), platinum as Pt(II) and/or Pt(IV), and rhodium as Rh(I) and/or Rh (III).

During method step (a), the at least one noble metal can transition at least partially, largely, or almost completely out of and/or from the carrier material into the hydrochloric aqueous phase, and thereby finally form the hydrochloric aqueous phase A1.

In principle, in the recovery of noble metal of and/or from spent heterogeneous catalysts containing noble metal, it is desirable to remove the noble metal(s) almost completely from the carrier material. An almost complete removal is to be understood as meaning that after removal of the noble metal, the carrier material has only ≤500 wt·ppm (ppm by weight) preferably ≤100 wt·ppm of noble metal, based on the total weight of carrier material plus the noble metal remaining therein. The method according to the invention is a method for recovering noble metal of and/or from said heterogeneous catalyst; more precisely, it is a method for recovering the at least one noble metal selected from the group consisting of palladium, platinum, and rhodium, of and/or from said heterogeneous catalyst. Preferably, the recovery takes place in the sense of the aforementioned almost complete removal from the carrier material.

The hydrochloric aqueous phase A1 of the two-phase system A may have a concentration of, for example, up to 12 mol of acid, in particular in the range of from 1 to 12 mol of acid ($H_3O^+$) per liter. The pH of the hydrochloric aqueous phase A1 may, for example, be in a range of −1 to +3.

The hydrochloric aqueous phase A1 of the two-phase system A comprises the part, transitioned from the carrier material, of the at least one noble metal present in an oxidation state>0 and in dissolved form, in a quantitative proportion, for example, in the range of 0.1 to 30 g/L.

The undissolved carrier material is in the two-phase system A in a quantitative proportion, for example, in the range of 10 to 1000 g/L of hydrochloric aqueous phase A1, preferably in a quantity of 50 to 100 g/L of hydrochloric aqueous phase A1.

The hydrochloric aqueous phase A1 of the two-phase system A surrounds the carrier material and is generally also present in the interior, for example in pores, of the carrier material.

The hydrochloric aqueous phase A1 can also contain further constituents, for example residues of oxidizing agents and/or of noble metal-free reaction products from the oxidation.

Optionally, it may be advantageous to dilute the hydrochloric aqueous phase A1 of the two-phase system A. Suitable diluents are, for example, a hydrochloric acid solution, hydrochloric acid, or water.

In the aforementioned preferred embodiment and also in the aforementioned further embodiment of the method according to the invention, step (b) takes place, in the course of which the hydrochloric aqueous phase A1 is at least partially separated from the two-phase system A and a further aqueous phase is added to the remaining residue of the two-phase system A to form a two-phase system B. The at least partial separation can take place, for example, by decanting, filtering, or centrifuging. Suitable further aqueous phases to be added are, for example, a hydrochloric acid solution, hydrochloric acid, or water. The two-phase system B thus formed comprises a hydrochloric aqueous phase B1 and a solid phase comprising the carrier material that is insoluble therein.

The hydrochloric aqueous phase B1 of the two-phase system B may have a concentration of, for example, up to 12 mol of acid, in particular 1 to 12 mol of acid ($H_3O^+$) per liter. The pH of the hydrochloric aqueous phase B1 may, for example, be in a range of −1 to +3.

The hydrochloric aqueous phase B1 of the two-phase system B comprises the at least one noble metal present in an oxidation state>0 and in dissolved form, in a quantitative proportion, for example, in the range of 0.01 to 30 g/L.

The undissolved carrier material is in the two-phase system B in a quantitative proportion, for example, in the range of 10 to 1000 g/L of hydrochloric aqueous phase B1, preferably in a quantity of 50 to 100 g/L of hydrochloric aqueous phase B1.

The hydrochloric aqueous phase B1 of the two-phase system B surrounds the carrier material and is generally also present in the interior, for example in pores, of the carrier material.

The hydrochloric aqueous phase B1 can also contain further constituents, for example residues of oxidizing agents and/or of noble metal-free reaction products from the oxidation.

Optionally, it may be advantageous to dilute the hydrochloric aqueous phase B1 of the two-phase system B. Suitable diluents are, for example, a hydrochloric acid solution, hydrochloric acid, or water.

If step (b) is realized in the method according to the invention, as is preferred, an optional step (b') can follow. This optional step is a step taking place repeatedly once or multiple times, of in each case at least partially separating the hydrochloric aqueous phase from a relevant two-phase system formed in the directly preceding step, and adding a further aqueous phase to form a further two-phase system comprising a hydrochloric aqueous phase and a solid phase comprising the carrier material that is insoluble therein. In the case of an only one-time or in the case of a first partial separation according to step (b'), the two-phase system formed in the directly preceding step is the two-phase system B formed in step (b).

In step (c) of the method according to the invention, cathodic electro-deposition of the at least one noble metal either (c1) from the hydrochloric aqueous phase A1 of the two-phase system A or (c2) from the hydrochloric aqueous phase B1 of the two-phase system B or (c3) from the hydrochloric aqueous phase of the two-phase system formed finally in step (b') takes place, i.e., in each case in the presence of the solid carrier material that is insoluble in the relevant hydrochloric aqueous phase. In the course of step (c), the entire hydrochloric aqueous phase in question is depleted of the at least one noble metal. "Entire hydrochloric aqueous phase" here means both its portions within (in particular, for example, pores and cavities) and outside the solid carrier material.

In the context of the method according to the invention, cathodic electro-deposition is understood to mean a method in which noble metal present in an oxidation state>0 is electrochemically reduced and is deposited in elemental form on or at a cathode.

During step (c), the solid carrier material can be homogeneously distributed in the relevant two-phase system in the sense of a suspension, for example as a result of stirring the two-phase system or flowing an inert gas through it. In a further embodiment, the solid carrier material can form the lower of the two phases and be unmoved, wherein only the hydrochloric aqueous upper phase is moved, for example by stirring. For example, the cathodic electro-deposition may also take place without stirring. It is also possible for the solid carrier material at the same time to be partially suspended and the residue to be settled on the bottom.

Suitable electrode materials are known in principle to the person skilled in the art. Electrodes made of graphite, titanium, or stainless steel have proven particularly suitable. According to the invention, the cathode may also be manufactured from noble metal, particularly advantageously from such noble metal as is also to be recovered. Electrodes with the largest possible surface area are particularly suitable. In principle, electrodes with any shape are suitable. It may be advantageous to use net- or fan-shaped electrodes. In one embodiment, a plurality of cathodes may be used.

Cathodic electro-deposition can be carried out without spatial separation of the partial reactions. However, it may also be advantageous to carry out a spatial separation of the partial reactions through membranes, diaphragms, or ion exchange membranes. For example, an anode chamber filled with dilute sulfuric acid can be used in this way, and chlorine development at the anode can thus be avoided.

It is particularly expedient during cathodic electro-deposition to work with a voltage in the range of 1.1 to 5 V.

The current density during cathodic electro-deposition may be in the range of, for example, 5 to 300 mA/cm$^2$, preferably in the range of 10 to 100 mA/cm$^2$, in particular in the range of 20 to mA/cm$^2$.

Cathodic electro-deposition may be carried out at room temperature, for example in the range of 15 to 25° C. or even at higher temperatures of, for example, up to 90° C. In particular when the cathodic electro-deposition from hydrochloric aqueous phase is carried out, it may be expedient to work at elevated temperatures, for example in the range of 70 to 90° C.

The duration of the cathodic electro-deposition is not further limited. It is inter alia based on the size of the electrode surface area, the set current density, the noble metal concentration at the beginning of step (c), and the time when the noble metal concentration in the hydrochloric aqueous phase falls below a desired limit value.

After step (c) has ended, the noble metal concentration in the hydrochloric aqueous phase may be <50 wt·ppm, preferably <10 wt·ppm. For example, the noble metal concentration may then be in the range of 0 to <50 wt·ppm, preferably in the range of 5 to <10 wt·ppm.

Method step (c) usually proceeds under acidic conditions in the sense of a cathodic electro-deposition of the at least one noble metal from the hydrochloric aqueous phase, which can have a pH in the range of −1 to +3, for example. All noble metals are deposited cathodically here.

In certain cases, however, it may be expedient, before carrying out the cathodic electro-deposition, to raise the pH of the hydrochloric aqueous phase into the basic pH range of, for example, ≥8 to 14, preferably ≥8 to 11.5, in particular ≥8 to 10; here, such a hydrochloric aqueous phase with a raised pH is referred to as a "basically-adjusted hydrochloric aqueous phase." In particular, it may be expedient, before carrying out the cathodic electro-deposition, to raise the pH of the hydrochloric aqueous phase into the basic pH range of, for example, 8 to 14, preferably 8 to 11.5, in particular 8 to 10 if the at least one noble metal comprises palladium or in particular is palladium. In this case, a step (c') can therefore be carried out immediately before step (c) in order to adjust a suitable basic pH in the range of, for example, 8 to 14, preferably 8 to 11.5, in particular 8 to 10. In this case, the relevant two-phase system A, B or the two-phase system formed finally in step (b') is admixed with ammonium hydroxide plus optionally additionally a further base, such as for example NaOH or KOH. The ammonium hydroxide may be fed as ammonia or preferably added as an aqueous solution; alternatively, it is however also possible to add an ammonium salt which releases ammonium hydroxide under the influence of a strong base, together with such a base, such as for example NaOH or KOH. Advantages of this basic adjustment of the pH include a reduction or avoidance of chlorine formation at the anode and the possibility of carrying out step (c) at increased current density with reduced hydrogen development. The electrochemical efficiency (ratio of deposited palladium to current density) can be improved. This particular embodiment of the method according to the invention is a method for recovering palladium of and/or from a heterogeneous catalyst comprising a solid carrier material and palladium present at least partially in elemental form, comprising the successive steps of:

(a) converting the palladium present at least partially in elemental form into an oxidation state>0 by treating the heterogeneous catalyst with oxidizing agent in the presence of hydrochloric acid to form a two-phase system A comprising a hydrochloric aqueous phase A1 and a solid phase comprising the carrier material that is insoluble therein, (b) optionally, but preferably, at least partially separating the hydrochloric aqueous phase A1 from the two-phase system A and adding a further aqueous phase to the remaining residue of the two-phase system A to form a two-phase system B comprising a hydrochloric aqueous phase B1 and a solid phase comprising the carrier material that is insoluble therein, (b') if step (b) has taken place, optionally, once or multiple times, repeatedly at least partially separating the hydrochloric aqueous phase from the two-phase system formed in the preceding step, and adding a further aqueous phase to form a further two-phase system comprising a hydrochloric aqueous phase and a solid phase comprising the carrier material that is insoluble therein, (c') adjusting a basic pH of the hydrochloric aqueous phase A1 of the two-phase system A or of the hydrochloric aqueous phase B1 of the two-phase system B or of the hydrochloric aqueous phase of the two-phase system formed finally in step (b'), in the range of ≥8 to 14, preferably ≥8 to 11.5, in particular ≥8 to 10, using ammonium hydroxide, and (c) cathodic electro-deposition of the palladium from the hydrochloric aqueous phase of the two-phase system basically adjusted in step (c'). Cathodic electro-deposition from the hydrochloric aqueous phase of the two-phase system basically adjusted in step (c') means that step (c) takes place in the presence of the solid carrier material that is insoluble in the basically-adjusted hydrochloric aqueous phase.

Step (c') is carried out using ammonium hydroxide; various bases of ammonium hydroxide, such as sodium hydroxide or potassium hydroxide, may additionally be used as stated. In particular, when adjusting a pH in the range of ≥8 to 10, it is possible to carry out the pH adjustment while using only ammonium hydroxide as a base.

After completion of the method according to the invention, it may be advantageous to recover the carrier material largely freed of noble metal. This is primarily the case when the carrier material is in the form of costly produced molded bodies; for this purpose, the method according to the invention can be carried out gently for the molded bodies and, for example, it is also possible to dispense with stirring during a relevant cathodic electro-deposition step.

Methods for further treatment of the elemental noble metal obtained in a relevant cathodic electro-deposition step are known to the person skilled in the art and depend, for example, on the type of noble metal, the method conditions, and/or the cathodes used. For example, the deposited noble metal can adhere to the cathode; for this case, it can subsequently be separated from the cathode, for example by mechanical treatment, or the cathode comprising the original electrode material and noble metal deposited thereon is further processed as a whole. It is also possible for the noble metal not to adhere to the cathode after electrochemical reduction; it may, for example, be present in the reaction space, which is particularly advantageously separated, in the form of powders or particles and may be separated by known methods.

Using the method according to the invention, noble metal, more precisely palladium, platinum, and/or rhodium, can be recovered from spent heterogeneous catalysts in an environmental and resource-saving manner. On the one hand, the direct electrolytic deposition requires less reactor volume. In addition, as a result of the volumes of washing medium or washing water that have been reduced in comparison to methods according to the prior art, hitherto necessary process steps and work-up steps are dispensed with, which means reduced energy and time expenditure.

EXEMPLARY EMBODIMENTS

Example 1

100 g of a heterogeneous catalyst (balls with 3 mm diameter; 0.511 wt. % of palladium on aluminum oxide) corresponding to 500 mg of palladium were mixed with 1 L of 6N hydrochloric acid. This two-phase system was flowed through with chlorine at 10 Nl/h at 60° C. for 15 min while stirring. Subsequently, chlorine was removed by holding at 90° C. for 30 min. After letting the solid constituents settle, 865 ml of the liquid phase were removed. From the removed liquid phase, 476 mg of palladium could be recovered hydrometallurgically. The two-phase residue was diluted with 160 ml of water and 7 g of ammonium chloride were added. Subsequently, 28 wt. % ammonium hydroxide solution was added until a pH of 8.8 was reached. In a subsequent electrolytic deposition at 25° C. and a current density of 33 mA/cm2 by means of graphite electrodes at 4 V, elemental palladium was deposited at the cathode at an electrochemical efficiency of 25%. The yield of total recovered palladium was 99.5%. Palladium analysis of the carrier material by means of ICP-OES showed a residual content of <10 wt·ppm of palladium based on the total weight of the carrier material.

Example 2

50 g of a heterogeneous catalyst (powder having a particle size of 100 μm to 1 mm); 2 wt. % of palladium on aluminum silicate) corresponding to 1000 mg of palladium was heated for 5 h at 800° C. in an air atmosphere and subsequently annealed for 2 h at 500° C. under $H_2$ atmosphere and subsequently mixed with 1 L of 6N hydrochloric acid. This two-phase system was flowed through with chlorine at 6 Nl/h at 60° C. for 15 min while stirring. Subsequently, chlorine was removed by holding at 85° C. for 30 min. After letting the solid constituents settle, 850 ml of the liquid phase were removed. From the removed liquid phase, 890 mg of palladium could be recovered hydrometallurgically. The two-phase residue was diluted with 150 ml of water and 7 g of ammonium chloride were added. Subsequently, 28 wt. % ammonium hydroxide solution was added until a pH of 8 was reached. In a subsequent electrolytic deposition at 25° C. and a current density of 33 mA/cm$^2$ by means of graphite electrodes at 4 V, elemental palladium was deposited at the cathode at an electrochemical efficiency of 25%. The yield of total recovered palladium was 99.5%. Palladium analysis of the carrier material by means of ICP-OES showed a residual content of <10 wt·ppm of palladium based on the total weight of the carrier material.

Example 3

100 g of a heterogeneous catalyst (powder having a particle size of 100 μm to 1 mm); 0.5 wt. % of palladium and 0.5 wt. % of platinum on aluminum oxide) corresponding to 500 mg of palladium and 500 mg of platinum were mixed with 1 L of 6N hydrochloric acid. This two-phase system was flowed through with chlorine at 6 Nl/h at 60° C. for 30 min while stirring. Subsequently, chlorine was removed by holding at 85° C. for 30 min. After letting the solid constituents settle, 850 ml of the liquid phase were removed. From the removed liquid phase, 470 mg of palladium and 450 mg of platinum could be recovered hydrometallurgically. The two-phase residue was diluted with 150 ml of water. In a subsequent electrolytic deposition at 85° C. and a current density of 33 mA/cm$^2$ by means of graphite electrodes at 1.8 V, elemental palladium and elemental platinum were deposited at the cathode at an electrochemical efficiency of 12%. The yield of total recovered noble metal (palladium and platinum) was 99.5%. Platinum and palladium analysis of the carrier material by means of ICP-OES showed a residual content of <10 wt·ppm of palladium and <10 wt·ppm of platinum based on the total weight of the carrier material.

Example 4

100 g of a heterogeneous catalyst (balls with 3 mm diameter; 0.511 wt. % of palladium on aluminum oxide) corresponding to 500 mg of palladium were mixed with 1 L of 6N hydrochloric acid. This two-phase system was flowed through with chlorine at 10 Nl/h at 60° C. for 15 min while stirring. Subsequently, chlorine was removed by holding at 90° C. for 30 min. After letting the solid constituents settle, 865 ml of the liquid phase were removed. From the removed liquid phase, 476 mg of palladium could be recovered hydrometallurgically. The two-phase residue was diluted with 150 ml of water. In a subsequent electrolytic deposition at 85° C. and a current density of 33 mA/cm$^2$ by means of graphite electrodes at 1.8V, elemental palladium was deposited at the cathode at an electrochemical efficiency of 12%. The yield of total recovered palladium was 99.5%. Palladium analysis of the carrier material by means of ICP-OES showed a residual content of <10 wt·ppm of palladium based on the total weight of the carrier material.

The invention claimed is:

1. A method for recovering noble metal of and/or from a heterogeneous catalyst comprising a solid carrier material and at least one noble metal which is selected from the group consisting of palladium (Pd), platinum (Pt), and rhodium (Rh), and is present at least partially in elemental form, comprising the successive steps of:

(a) converting the at least one noble metal present at least partially in elemental form into an oxidation state>0 by treating the heterogeneous catalyst with an oxidizing agent in the presence of hydrochloric acid to form a two-phase system A comprising a hydrochloric aqueous phase A1 and a solid phase comprising the carrier material that is insoluble therein, (b) at least partially separating the hydrochloric aqueous phase A1 from the two-phase system A, and adding a further aqueous phase to the remaining residue of the two-phase system A to form a two-phase system B comprising a hydrochloric aqueous phase B1 and a solid phase comprising the carrier material that is insoluble therein, wherein the further aqueous phase is a hydrochloric acid solution, hydrochloric acid, or water, (b') optionally, once or multiple times, repeatedly at least partially separating the hydrochloric aqueous phase from the two-phase system formed in the preceding step, and adding a further aqueous phase to form a further two-phase system comprising a hydrochloric aqueous phase and a solid phase comprising the carrier material that is insoluble therein, and (c) in the presence of the solid phase comprising the carrier material, cathodically electro-depositing the at least one noble metal from (c1) the hydrochloric aqueous phase A1 of the two-phase system A, (c2) the hydrochloric aqueous phase B1 of the two-phase system B, or (c3) the hydrochloric aqueous phase of the two-phase system formed finally in step (b').

2. The method according to claim 1, wherein step (c) comprises cathodically electro-depositing the at least one noble metal from (c2) the hydrochloric aqueous phase B1 of the two-phase system B.

3. The method according to claim 1, further comprising step (b'), wherein step (c) comprises cathodically electro-depositing the at least one noble metal from (c3) the hydrochloric aqueous phase of the two-phase system formed finally in step (b').

4. A method for recovering palladium of and/or from a heterogeneous catalyst comprising a solid carrier material and palladium present at least partially in elemental form, comprising the successive steps of:

(a) converting the palladium present at least partially in elemental form into an oxidation state>0 by treating the heterogeneous catalyst with an oxidizing agent in the presence of hydrochloric acid to form a two-phase system A comprising a hydrochloric aqueous phase A1 and a solid phase comprising the carrier material that is insoluble therein, (b) at least partially separating the hydrochloric aqueous phase A1 from the two-phase system A, and adding a further aqueous phase to the remaining residue of the two-phase system A to form a two-phase system B comprising a hydrochloric aqueous phase B1 and a solid phase comprising the carrier material that is insoluble therein, wherein the further aqueous phase is a hydrochloric acid solution, hydrochloric acid, or water, (b') optionally, once or multiple times, repeatedly at least partially separating the hydrochloric aqueous phase from the two-phase system formed in the preceding step, and adding a further aqueous phase to form a further two-phase system comprising a hydrochloric aqueous phase and a solid phase comprising the carrier material that is insoluble therein, (c') adjusting a basic pH of the hydrochloric aqueous phase A1 of the two-phase system A or of the hydrochloric aqueous phase B1 of the two-phase system B or of the hydrochloric aqueous phase of the two-phase system formed finally in step (b'), in the range of ≥8 to 14 using ammonium hydroxide, and (c) in the presence of the solid phase comprising the carrier material, cathodically electro-depositing the palladium from the hydrochloric aqueous phase of the two-phase system basically adjusted in step (c').

5. The method according to claim 1, wherein the heterogeneous catalyst is a spent heterogeneous catalyst.

6. The method according to claim 1, wherein the heterogeneous catalyst has been subjected to one or more pretreatment steps before step (a).

7. The method according to claim 1, wherein the oxidizing agent is selected from chlorates, nitrates, bromates, iodates, chlorites, bromites, iodites, hypochlorites, perchlorates, peroxide compounds, chlorine, and/or ozone.

8. The method according to claim 1, wherein the noble metal recovery takes place in the sense of an almost complete removal from the carrier material.

9. The method according to claim 1, wherein the cathodic electro-deposition is carried out with spatial separation of the partial reactions.

10. The method according to claim 1, wherein the cathodic electro-deposition takes place until a noble metal concentration of <50 wt·ppm in the hydrochloric aqueous phase is reached.

11. The method according to claim 4, further comprising step (b), wherein step (c') comprises adjusting a basic pH of the hydrochloric aqueous phase B1 of the two-phase system B.

12. The method according to claim 4, further comprising step (b'), wherein step (c') comprises adjusting a basic pH of the hydrochloric aqueous phase of the two-phase system formed in step (b').

* * * * *